US012193553B2

(12) United States Patent
Lee

(10) Patent No.: US 12,193,553 B2
(45) Date of Patent: Jan. 14, 2025

(54) SLIDING COLOR COSMETIC CASE

(71) Applicant: CTK COSMETICS CO., LTD., Seoul (KR)

(72) Inventor: Young Joo Lee, Anyang-si (KR)

(73) Assignee: CTK COSMETICS CO., LTD., Seoul (KR)

( * ) Notice: Subject to any disclaimer, the term of this patent is extended or adjusted under 35 U.S.C. 154(b) by 219 days.

(21) Appl. No.: 17/414,242

(22) PCT Filed: Jan. 4, 2019

(86) PCT No.: PCT/KR2019/000149

§ 371 (c)(1),
(2) Date: Jun. 15, 2021

(87) PCT Pub. No.: WO2020/141646

PCT Pub. Date: Jul. 9, 2020

(65) Prior Publication Data

US 2022/0022623 A1 Jan. 27, 2022

(51) Int. Cl.
*A45D 33/00* (2006.01)

(52) U.S. Cl.
CPC ..... *A45D 33/008* (2013.01)

(58) Field of Classification Search
CPC ..... A45D 33/36; A45D 33/008; A45D 33/20; A45D 33/22; A45D 33/28; A45D 40/22; A45D 40/221; A45D 33/00; A45D 33/18; A45D 33/26; A45D 40/00; A45D 40/24
See application file for complete search history.

(56) References Cited

U.S. PATENT DOCUMENTS

| | | | | | |
|---|---|---|---|---|---|
| 1,813,147 | A * | 7/1931 | Coryell | A45D 33/28 | 132/297 |
| 1,895,061 | A * | 1/1933 | Worssam | A45D 33/20 | 206/229 |
| 2,031,933 | A * | 2/1936 | Clegg | A45D 33/20 | 132/287 |
| 2013/0048009 | A1* | 2/2013 | Crapet | A45D 33/003 | 132/287 |

FOREIGN PATENT DOCUMENTS

| | | | |
|---|---|---|---|
| JP | 3169133 U | | 7/2011 |
| KR | 10-200425540 | * | 9/2006 |
| KR | 2008-0001292 U | | 1/2008 |
| KR | 20-2011-0000527 | * | 1/2011 |
| KR | 20-2011-0000527 U | | 1/2011 |

(Continued)

OTHER PUBLICATIONS

Machine Translation of Shim et al. Available Jan. 2011.*

*Primary Examiner* — Rachel R Steitz
*Assistant Examiner* — Karim Asqiriba
(74) *Attorney, Agent, or Firm* — Bridgeway IP Law Group, PLLC; Jihun Kim

(57) ABSTRACT

Proposed is a sliding color cosmetic case comprising a lower sliding member, a color cosmetic case, an inclined protrusion member, and a sliding cover member. According to the present invention, when the lower sliding member of the color cosmetic case slides to one side, a mirror cover in which an application tip is embedded stands tilted so as to allow a user to easily see a mirror and easily take out the application tip.

2 Claims, 3 Drawing Sheets

(56) References Cited

FOREIGN PATENT DOCUMENTS

| | | | |
|---|---|---|---|
| KR | 200454356 | * | 6/2011 |
| KR | 10-1288852 | * | 7/2013 |
| KR | 10-2013-0140105 | A | 12/2013 |
| KR | 10-2016-0095349 | A | 8/2016 |
| KR | 20-0485912 | Y1 | 3/2018 |
| KR | 10-1935731 | B2 | 1/2019 |

* cited by examiner

SLIDING COLOR COSMETIC CASE

TECHNICAL FIELD

The present invention relates to a sliding color cosmetic case, and more particularly, to a sliding color cosmetic case that is capable of allowing an inclined protrusion member in which an application tip is built to be slantly erected if a lower sliding member slides toward one side direction, so that a mirror attached to the inclined protrusion member can be seen well and the application tip can be easily drawn from the inclined protrusion member.

BACKGROUND ART

As modern societies have been diversified quickly, today, everyone including men, women, the young, and the aged use cosmetics often if necessary, as mentioned in Korean Utility Model Registration No. 2008-0001292, and especially in the case of women, they use various types of cosmetics and various color cosmetic containers and tools. Through many studies and developments in the fields related to the cosmetics, a variety of good qualities of cosmetic containers and tools have been launched daily in the market.

Generally, cosmetics are largely classified into base makeup cosmetics, color makeup cosmetics, hair care products, and body care products, and among them, the color makeup cosmetics are used to make a user' face appear more beautiful after the base makeup cosmetics have been used, which are practical makeup cosmetics used in consideration of beauty, colors, and trend, so that the effectiveness of the color makeup cosmetics may be greatly different according to application methods or skills.

The color makeup cosmetics are largely classified into skin care cosmetics including makeup bases, foundations, and powder foundations, eye makeup cosmetics including eye shadows, eye liners, eyeblow pencils, and mascaras, lip makeup cosmetics including lipsticks, lip glosses, and lip cream, and cheek makeup cosmetics using cosmetics applied to the cheeks and chin.

The color cosmetics have lipsticks or eye shadow pencils type cosmetics, cake type cosmetics, and cream type cosmetics, and the cake or cream type cosmetics are configured to accommodate various color cosmetic materials in one case, so that the cake or cream type cosmetics have higher preference than other types of color cosmetics. Further, a makeup brush is accommodated in the color cosmetic case.

A conventional color cosmetic case like a lipstick or eye shadow used for color makeup includes a case body configured to accommodate various color cosmetic materials in an accommodation portion in which a plurality of accommodation spaces is partitioned and to insertedly seat a makeup brush onto one side thereof and a cover coupled to the case body by means of hinges in such a manner as to be rotatable to a given angle and having a mirror attached to the inner surface thereof.

According to the conventional color cosmetic case, the cover is first open by a user, and in a state where a drawn protrusion of the makeup brush is held by the user, an appropriate amount of color cosmetic material is applied to the makeup brush. Next, the color cosmetic material is applied to the user's desired area from the makeup brush, while using the mirror attached to the inner surface of the cover, and after that, if the color makeup to her desired color is finished, the makeup brush is insertedly seated on the given position in the case body.

The conventional color cosmetic case is commonly kept in a woman's handbag, but while moving, it may cause noise because the makeup brush in the case body collides against the inner surface of the case body, without being fixed. In addition, the color cosmetic material applied to the makeup brush may be applied to tops of the color cosmetic materials seated on the accommodation portion, thereby undesirably causing the color cosmetic materials to be changed in color.

If the makeup is performed by using the makeup brush seated on the inside of the color cosmetic case, further, the makeup brush has to be drawn by insertion of the user's fingers into the case body, and during the drawing process, the makeup brush may fall to the floor often, thereby being undesirably contaminated.

If it is desired to open the cover of the color cosmetic case, in addition, the cover has to be open, for example, by the user's right hand in a state where the lower portion of the case body is fixed to his or her left hand, and during the opening process, if his or her left hand slips on the lower portion of the case body, the cake type color cosmetic materials stored in the accommodation portion may be cracked due to impacts.

In addition, the makeup brush as a tool for applying the cosmetic material is built in the eye shadow case, but the makeup brush is not fixedly stored in a rectangular box-shaped accommodation space formed in the eye shadow case. If the cover of the eye shadow case is open, accordingly, the makeup brush may bounce off the accommodation space, so that it is inconvenient to draw the makeup brush from the accommodation space to the outside.

DISCLOSURE

Technical Problem

Accordingly, the present invention has been made in view of the above-mentioned problems occurring in the related art, and it is an object of the present invention to provide a sliding color cosmetic case that is capable of allowing an inclined protrusion member in which an application tip is built to be slantly erected if a lower sliding member slides toward one side direction, so that a mirror attached to the inclined protrusion member can be seen well and the application tip can be easily drawn from the inclined protrusion member.

Technical Solution

To accomplish the above-mentioned objects, according to one aspect of the present invention, there is provided a sliding color cosmetic case including: a lower sliding member which is a rectangular box-shaped member whose top is open and bottom is closed and having left, right, and one side walls and a sliding side wall located on the other side facing one side wall in such a manner as to be higher than the left, right, and one side walls; a color cosmetic case which is a rectangular member located at the insides of the left, right, and one side walls of the lower sliding member and having spaces partitioned on top thereof to accommodate color cosmetic trays therein and hinge coupling portions formed on the sides toward the sliding side wall; an inclined protrusion member which is a rectangular member located around the sliding side wall of the lower sliding member in such a manner as to be slantly coupled to the color cosmetic case through a hinge shaft and a spring fitted to the hinge coupling portions of the color cosmetic case and having a mirror attached to top thereof and an application tip storing slit formed on the side surface facing the hinge coupling portions to accommodate an application tip therein; and a sliding cover member which is a rectangular box-shaped member adapted to slidingly cover the lower sliding member, the color cosmetic case located in the lower sliding member, and the inclined protrusion member in such a manner as to allow a front surface as a sliding insertion surface fitted to one side wall of the lower sliding member to be open and to allow left, right, top, underside, and rear surfaces to be closed.

According to the present invention, the sliding cover member has first and second holes punched in the top surface thereof and a transparent window attached to the second hole.

According to the present invention, the application tip storing slit has protrusions formed from the inner side surfaces thereof to prevent the application tip from escaping therefrom when the inclined protrusion member is slant and notches cut in a horizontal direction on the intermediate portions of the protrusions so that the application tip can be easily taken out from the application tip storing slit and thus conveniently used.

Advantageous Effects

According to the present invention, the sliding color cosmetic case is configured to allow the inclined protrusion member in which the application tip is built to be slantly erected if the lower sliding member slides toward one side direction, so that the mirror attached to the inclined protrusion member can be seen well and the application tip can be easily drawn from the inclined protrusion member.

MODE FOR INVENTION

Figure 1:
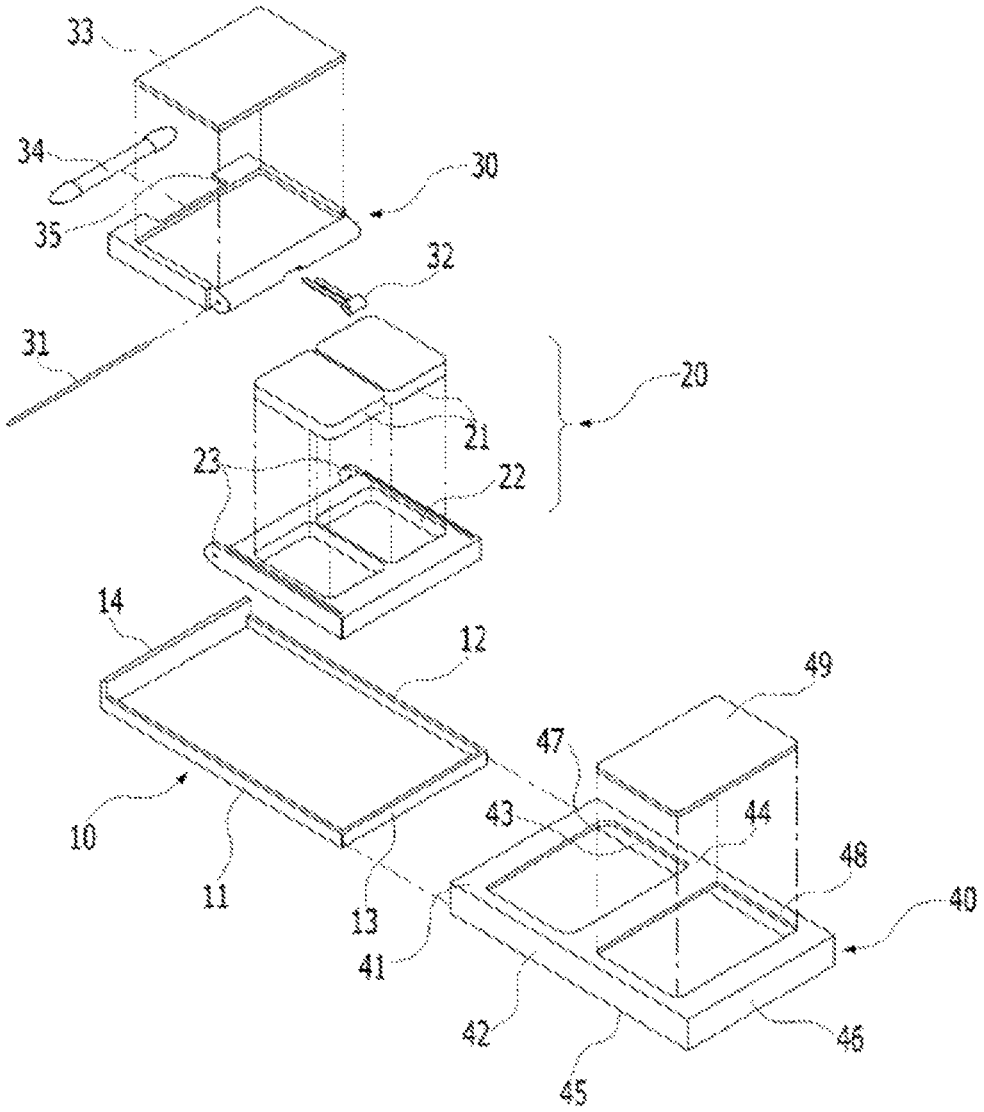
FIG. 1 is an exploded perspective view showing a sliding color cosmetic case according to the present invention.

Hereinafter, an explanation of the present invention will be in detail given with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description. In the description, the thicknesses of the lines or the sizes of the components shown in the drawing may be magnified for the clarity and convenience of the description. Further, the terms as will be discussed later are defined in accordance with the functions of the present invention, but may be varied under the intention or regulation of a user or operator. Therefore, they should be defined on the basis of the whole scope of the present invention.

Terms, such as the first, the second, A, and B, may be used to describe various elements, but the elements should not be restricted by the terms. The terms are used to only distinguish one element from the other element. For example, a first element may be named a second element without departing from the scope of the present invention. Likewise, a second element may be named a first element. A term 'and/or' includes a combination of a plurality of relevant and described items or any one of a plurality of related and described items.

Terms, such as 'front', 'rear', 'top', 'underside', and the like used to describe various positions of an object in the drawings may be replaced with terms, such as 'first', 'second', and the like.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

All terms used herein, including technical or scientific terms, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification.

Now, an explanation of a sliding color cosmetic case according to the present invention will be in detail given with reference to the attached drawing. If it is determined that the detailed explanation on the well known technology related to the present invention makes the scope of the present invention not clear, the explanation will be avoided for the brevity of the description.

Figure 2:
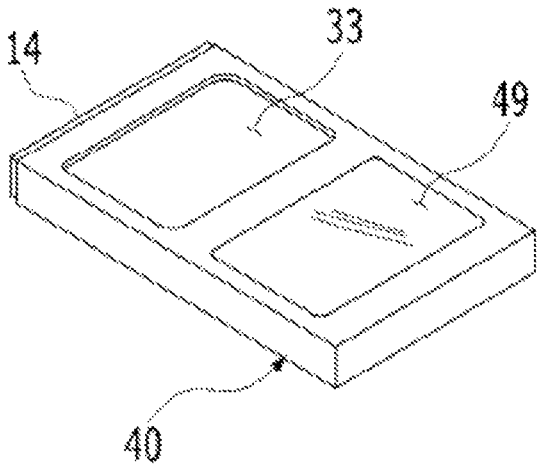
FIG. 2 is a perspective view showing the sliding color cosmetic case according to the present invention.
Figure 3:
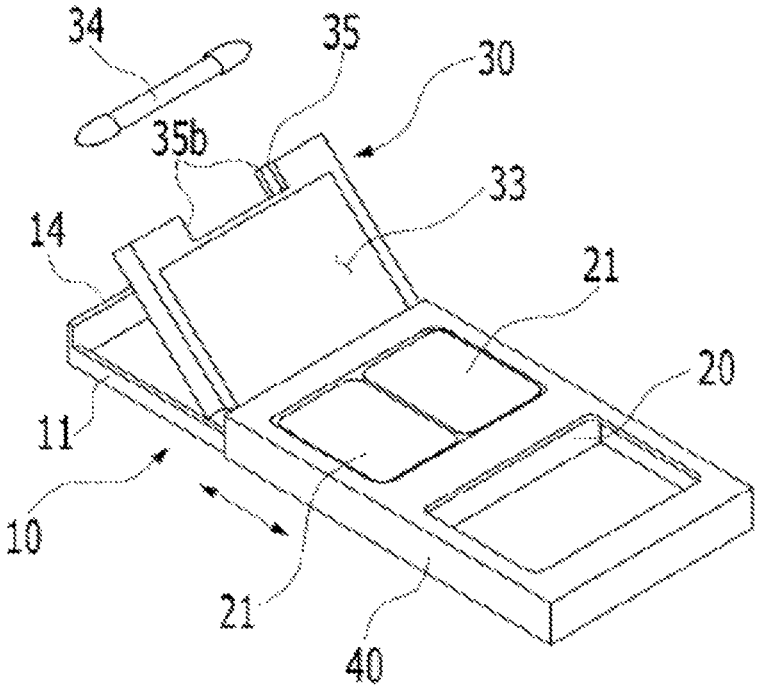
FIG. 3 is a perspective view showing a state where the sliding color cosmetic case according to the present invention is used.

FIG. 1 is an exploded perspective view showing a sliding color cosmetic case according to the present invention, FIG. 2 is a perspective view showing the sliding color cosmetic case according to the present invention, and FIG. 3 is a perspective view showing a state where the sliding color cosmetic case according to the present invention is used.

As shown in FIGS. 1 to 3, a sliding color cosmetic case according to the present invention includes: a lower sliding member 10 which is a rectangular box-shaped member whose top is open and bottom is closed and having left, right, and one side walls 11, 12, and 13 and a sliding side wall 14 located on the other side facing one side wall 13 in such a manner as to be higher than the left, right, and one side walls 11, 12, and 13; a color cosmetic case 20 which is a rectangular member located at the insides of the left, right, and one side walls 11, 12 and 13 of the lower sliding member 10 and having spaces 22 partitioned on top thereof to accommodate color cosmetic trays 21 therein and hinge coupling portions 23 formed on the sides toward the sliding side wall 14; an inclined protrusion member 30 which is a rectangular member located around the sliding side wall 14 of the lower sliding member 10 in such a manner as to be slantly coupled to the color cosmetic case 20 through a hinge shaft 31 and a spring 32 fitted to the hinge coupling portions 23 of the color cosmetic case 20 and having a mirror 33 attached to top thereof and an application tip storing slit 35 formed on the side surface facing the hinge coupling portions 23 to accommodate an application tip 34 therein; and a sliding cover member 40 which is a rectangular box-shaped member adapted to slidingly cover the lower sliding member 10, the color cosmetic case 20 located in the lower sliding member 10, and the inclined protrusion member 30 in such a manner as to allow a front surface as a sliding insertion surface 41 fitted to one side wall 13 of the lower sliding member 10 to be open and to allow left, right, top, underside, and rear surfaces 42, 43, 44, 45, and 46 to be closed.

The sliding cover member 40 has first and second holes 47 and 48 punched in the top surface 44 thereof and a transparent window 49 attached to the second hole 48.

The application tip storing slit 35 has protrusions 35*a* formed from the inner side surfaces thereof to prevent the application tip 34 from escaping therefrom when the inclined protrusion member 30 is slant. Further, notches 35*b* cut in a horizontal direction on the intermediate portions of the protrusions 35 so that the application tip 34 can be easily taken out from the application tip storing slit 35 and then conveniently used.

Next, an explanation of operations and effectiveness of the sliding color cosmetic case according to the present invention will be given.

Referring first to the coupling process of the sliding color cosmetic case, the color cosmetic case 20 and the inclined protrusion member 30 coupled to the color cosmetic case 20 through the hinge shaft 31 and the spring 32 are located in the lower sliding member 10. Next, the sliding insertion surface 41 as the front surface of the sliding cover member 40 is slidingly fitted to the side wall 13 of the lower sliding member 10.

After the sliding fitting, the color cosmetic case 20 and the inclined protrusion member 30 are displayed through the first and second holes 47 and 48 (See FIG. 2).

If the sliding side wall 14 of the lower sliding member 10 is drawn to the outside to use the color cosmetics, the inclined protrusion member 30 is drawn to slantly protrude from the color cosmetic case 20 by means of the spring 32. That is, the inclined protrusion member 30 gets inclined to allow the mirror 33 to be seen well by a user (See FIG. 3).

As the inclined protrusion member 30 slantly protrudes, the application tip 34 can be easily taken out from the application tip storing slit 35. Through the notches 35*b*, that is, the application tip 34 can be easily taken out from the application tip storing slit 35.

When the inclined protrusion member 30 slantly protrudes, simultaneously, the color cosmetic case 20 is drawn to the outside and thus displayed on the first hole 47 where the transparent window 48 does not exist.

As the transparent window is not provided on the first hole 47, that is, the color cosmetics in the color cosmetic trays 21 can be exposed to the outside so that they can be applied.

After the use of the color cosmetics, the application tip 34 is put into the application tip storing slit 35, and the lower sliding member 10 is pushed and inserted into the sliding cover member 40. As a result, as shown in FIG. 2, the mirror 33 of the inclined protrusion member 30 is displayed on the first hole 47, and the trays 21 of the color cosmetic case 20 are displayed through the transparent window 49 placed on the second hole 48. In this state, the mirror 33 can be always seen.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A sliding color cosmetic case comprising:

a sliding member having a rectangular box shape, wherein the sliding member has an open top end and a closed bottom end, wherein the sliding member has front, left, right, and rear side walls in a longitudinal direction thereof, the front side wall being located opposite to the rear side wall, wherein the front side wall has a height higher than those of the left, right, and rear side walls;

a cosmetic case disposed in the sliding member to be surrounded by the front, left, right, and rear side walls and having at least one container on top thereof to accommodate at least one color cosmetic tray therein, wherein the cosmetic case has a pair of front protrusions positioned apart from each other and extending toward the front wall of the lower sliding member and hinge coupling holes formed on the pair of front protrusions;

an inclinable member hinge-coupled to the cosmetic case through a hinge shaft fitted to the hinge coupling holes of the cosmetic case, wherein the inclinable member has a front end portion and a rear end portion with respect to the longitudinal direction, in which the hinge shaft is coupled to the rear end portion, wherein the inclinable member has a spring disposed at the rear end portion to allow the inclinable member to be rotated around the hinge shaft when it is released from a cover member, wherein the inclinable member has a mirror attached to a top outer surface thereof, wherein the inclinable member has an application tip storing slit formed at the front end portion thereof to accommodate an application tip therein; and the cover member having a rectangular box shape adapted to cover the sliding member, the cosmetic case, and the inclinable member by a sliding movement of the sliding member, wherein the cover member has an open front end to allow the open front end to be fitted to the front side wall of the sliding member when the cover member fully covers the sliding member, wherein at least two protrusions formed on an inner side surfaces of the inclinable member and extending from a front end thereof to surround the application tip storing slit to prevent the application tip from escaping therefrom when the inclinable member is rotated, and further includes notches cut in a horizontal direction on intermediate portions of the at least two protrusions to allow a user to grip the application tip to take it from the application tip storing slit.

2. The sliding color cosmetic case according to claim 1, wherein the cover member includes at least one opening formed on a top surface thereof and a transparent window attached to one of the at least one opening.

* * * * *